United States Patent [19]

Lloyd et al.

[11] 4,170,312

[45] Oct. 9, 1979

[54] CONTAINER

[75] Inventors: Robert Lloyd, Galston; Maxwell J. Turner, Sylvania, both of Australia

[73] Assignee: Energy Recycling Corporation Pty. Ltd., Sylvania, Australia

[21] Appl. No.: 800,147

[22] Filed: May 24, 1977

[30] Foreign Application Priority Data

May 27, 1976 [AU] Australia ..... PC6072

[51] Int. Cl.[2] ..... B65D 7/18; B65D 25/14; B65D 81/02

[52] U.S. Cl. ..... 224/4 B; 206/522; 217/122; 220/4 E; 220/19; 220/83

[58] Field of Search ..... 220/83, 4 B, 4 E, 19; 217/122; 206/522

[56] References Cited

U.S. PATENT DOCUMENTS

| | | | |
|---|---|---|---|
| 254,236 | 2/1882 | Phipps | 217/122 |
| 1,494,195 | 5/1924 | Smith | 217/122 |
| 2,486,838 | 11/1949 | Goldstrom | 220/83 |
| 2,744,650 | 5/1956 | Woessner | 220/4 E |
| 2,774,503 | 12/1956 | Moore | 206/522 |
| 2,797,178 | 6/1957 | Noyes | 220/83 |
| 3,001,900 | 9/1961 | Frieder | 220/83 |
| 3,142,422 | 7/1964 | Mojonnier | 220/4 B |
| 3,346,101 | 10/1967 | Pestka | 206/522 |

*Primary Examiner*—George E. Lowrance
*Attorney, Agent, or Firm*—Ladas, Parry, Von Gehr, Goldsmith & Deschamps

[57] ABSTRACT

Disclosed is a new type of goods container which allows for economical transportation of bulk solids, especially low grade particulate matter. The container has a casing formed from woven metallic strips and is sealed from the inside. It is very strong and rigid providing it has been correctly filled and compacted. Novel apparatus for constructing the container is also provided as one method of filling and compacting the material to be transported. The container can be easily and quickly constructed at the filling site and scrapped at the end of its journey.

9 Claims, 17 Drawing Figures

FIG.15
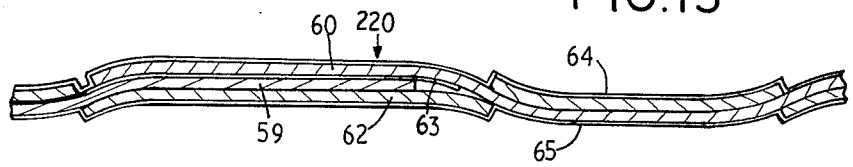
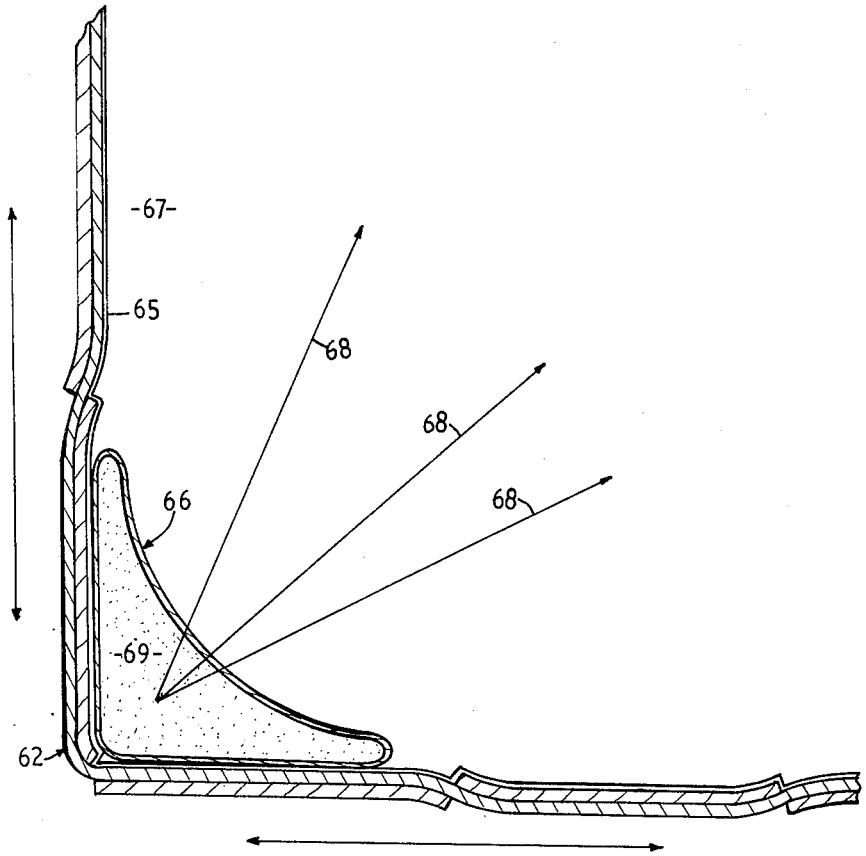
FIG.16

CONTAINER

This invention relates to a transportation container, and in particular to a container for transporting particulate matter.

Generally particulate matter, such as coal, other mining products, and grain crops, undergoes between its original point of availability (e.g. minehead) and its final destination a series of loading, road or rail transport, unloading, storage, reloading, shipping, unloading from the ship, reloading for further road or rail transport and again unloading at the final point of destination.

To handle all the operations of loading and unloading, bulk handling means such as conveyors, grabs or pneumatic transport are generally used. All these means repeatedly expose the product to the atmosphere at some stage of handling, and may be subject to interruptions due to rain.

As most particulate products contain a certain percentage of fine particles, these particles are easily disseminated into the atmosphere during handling, causing pollution and loss of product. Additionally by exposing the product to atmospheric conditions the moisture content of the product may be varied beyond the required acceptable limits wherein the product quality may be damaged or handling impaired.

Bulk handling also creates its own self-grinding effect on the particulate matter being handled and thus may reduce the original particle size somewhat, thus producing more "fine" particles than is desirable or acceptable, which compounds the abovementioned pollution and quality problems.

Currently with the emphasis and laws on pollution control becoming a major factor on the economics of particulate materials handling, the loss of "fines" pertaining to the shipment of say coal restricts seriously the grain size of the coal that can be transported by normal bulk handling facilities. This in itself means that where coal is of an extremely fine particle size, it cannot be handled and transported and must be separated from the larger coal particles at the mine and wasted. The waste fines in themselves are a major pollutant.

Many seams of coal, which are of a low quality must be reduced to a grain size, to remove the inherent ash, that would preclude their being transferred by normally accepted bulk handling systems for coal, due to the dust and ecological problems that would ensue.

A further problem of all coals in transport and storage is that of spontaneous combustion and this problem is particularly dangerous when the coal includes or consists of fine particles. These dangers of combustion are there only because of the presence in the atmosphere surrounding the particle of moisture and oxygen. If the levels of moisture and oxygen can be lowered and maintained the risk of spontaneous combustion or any form of ignition is totally removed.

On a first inspection of the problem one may suggest the use of shipping the coal fines in containers, which should overcome the technical problems. The word containers being used to describe generically the type of rectangular prism shaped container presently used by the shipping industry.

However, the use of known containers poses further problems.

As the mine head is usually remote from the point of shipping and final destination, a large transport and handling cost component of the empty containers back to the minehead, for refilling, exists. The containers, valued at some thousands of dollars are far too valuable to scrap at the end of each shipment.

Thus the use of known containers is uneconomic. To produce a lightweight disposable container having sheet metal sides is not possible as the wall thickness must approach that of existing containers for the required strength. However, the idea of using a container is sound, as containers are readily handled without the side effects of pollution and, if the containers can be sealed, the moisture content and environment of the contents can be exactly controlled. Even if it is not perfectly sealed the container may still substantially maintain the quality of its contents.

It is an object of this invention to ameliorate the abovementioned disadvantages.

In one broad form the invention provides a container for particulate matter, comprising a tightly woven closed case formed from metallic strips interwoven into a rectangular or square prismatic shape having two opposite end walls and two pairs of opposite side walls extending between said end walls.

The casing is preferably formed into a rectangular prism for the purposes of stacking and maximisation of available space. By weaving the case of the container using strips of metal, such as steel, there is provided a structure which is very much stronger than a sheet steel structure of the same size and same total wall thickness. Weaving provides two strips one on top of the other at each weave, thus the extra strength due to weaving is provided by the distribution of stresses and avoidance of point loads at the centres of the sides. The use of metal strips also allows for heavier gauge metal to be used at regions of maximum stress.

As such a woven structure is obviously not sealed in itself, it is desirable to seal it for transport of most materials. To seal the casing the metallic strips may have applied to them prior to the weaving operation, a layer of plastic semi-soft sealing material. As the strips are interwoven in place during forming of the container case, this sealing material is compacted between the joints themselves and the surfaces of the case, in such a way as to be forced into the gaps which make up the joints between the strips, thereby totally sealing all joints of the case.

Alternatively once the case has been formed it may be sealed by inserting a plastic sheet type material into it, and possibly adhering such material to the inner walls of the case.

However the preferred method of sealing the case is to apply, by say spraying, a sealant to the inside of the case. Such a sealant may be a heat actuable plastics material, or even a starch product, which when actuated melts and flows into the interstices of the weave.

The container being of a metallic material may be easily handled by usual methods of container handling, such as fork lifts, electromagnets or cables attached to lifting hooks which may be provided on the container. Where a non-ferromagnetic metal has been used, insertion of steel strips at appropriate points inside the casing allows for the use of electromagnets.

In a further broad form the invention provides a method of making a woven strip container by forming a first open ended section having an end wall and four side walls extending therefrom comprising the steps of weaving said end wall from metallic strips such that the free ends of the woven strips extend beyond the woven end wall on each of the four sides thereof, bending the unwoven portions of the strip through approximately 90° so that there are two pairs of opposite sides extending from the perimeter of said end wall; displacing the end of each alternate strip from the plane of the side and sliding a preformed metallic strip ring between the displaced ends of all four sides simultaneously, along the lengths of the unwoven strips until it abuts the woven end; alternating the displacement of the free ends of aid unwoven strips and sliding a further ring along the strips until it abuts the first ring; repeating the steps of alternating the ends and adding rings until the final ring is in place, said final ring having its outer edge approximately aligned with the outer end of the strips longitudinally displaced closest to the end wall; forming a second open ended section identically to the first and joining the two sections at their open ends to form the closed container.

Once the case has been formed it is then picked up by magnetic handling devices and placed in position for filling.

The case may then be placed in a chamber, such that one corner of the case is lower than any other point of the case so that the case can be filled from a point at the uppermost diagonally opposite region.

The chamber is constructed such that when the container has been placed in this chamber and the chamber closed, electromagnets on the ends of hydraulic rams attach to the centre of the walls of the case and move away from the case. This places the case in tension in all directions. The container is then filled through a spear which has penetrated the casing. On release of the electromagnets the casing remains in its tensioned state due to its material filling. Compaction of the inner filled material may be achieved by varying the magnetic field to vibrate the walls of the container.

Alternatively in the case where the internal surfaces of the casing has been totally sealed, the tensioning pressure may be applied by the closing of the chamber and forming of a vacuum in the space between the container walls and the chamber walls. This has the effect of fully expanding the woven structure of the casing so that once it has been filled and the vacuum released, it will remain in its expanded state. Compaction of the filled material may be achieved by fluctuating the vacuum to vibrate the casing.

At a designated point at the top of the case there is provided a seal which is in contact between the top of the case and the roof of the chamber. At this point a hollow spear with an open end is inserted through the case. A second hollow spear may also be inserted through the top of the case. The material, which is to be filled into the case, is applied through the larger of the spears. The other spear provides a passage for air displaced from said casing to escape. The chamber in which the case is being filled may have a vibrator attached to it to vibrate and thus compact the material. The chamber may also have means to automatically tilt the casing into positions to permit the total filling of the casing in accordance with the material being filled. The material is directed by the spear into the case in such a way as to ensure that the case is totally filled. In addition to the material to be filled into the case, a particular atmosphere, which may be desired to be present during the time that the material is in the case, may be added. When the case is totally filled to the required density, the spears are removed and a special plug inserted in each of the holes, which permits any excess atmosphere to be expelled up to the point that the pressure exerted by the material adjacent to the hole, applies such pressure on the special plug as to force its sealing.

Obviously any number of spears may be used. The filled container is ejected sideways from the chamber through the open door and is picked up magnetically on the two side faces and placed in position for transport.

To empty the case the plugs are removed or an end section of the case is cut out. The contents may have to be vibrated to break the bridging effect of the particles to empty the container. The affect of the case on the material, which has been placed in it is as follows:

Due to the tensioning of the case and compaction of the material there is sufficient friction between each particle to hold the total mass of material in a solid block in the form which it took at the point of prestressing.

When the block is being handled the gravitational forces tend to pull the centre of the block downwards, as it is unsupported. However, as the surfaces of the case have the roughening effect of the woven basket weave, the sheer factor and compression present between the case and the inner material, and any inner braces, lock that material to its position within the case and, provided the lifting is done with a scissors action and/or magnetic contact, no slackening of the case can be anticipated.

As this inteference and friction set up on the wall of the case positions that material, an arching affect is created within the rest of the block. This affect removes the forces of gravity from a vertical downward direction to an arch directing stresses to the corners and leaves only a small segment in the centre of the base of the container without true support. This support is in turn supplied in two ways, by the pre-tensioning of the case and by the strengthening torsion braces fitted between walls of the container.

A further broad form of the invention provides apparatus for forming a woven closed container comprising a case having two end walls and four side walls extending therebetween; said apparatus comprising a device for weaving open ended part cases comprising a tabletop having dimensions approximately the same as those of the end of said container; means to arrange and grip one end of a plurality of strips in parallel relationship on said table, and to longitudinally displace alternate strips by about one strip width; means to grip the opposite end of said strips to reciprocably displace alternate strips from the normal plane of said strips; means to receive and direct a first transverse strip between said strips displaced from their normal plane and the alternate strips still in said plane; means to move said transverse strip to align with the edge of said table; means to insert a second transverse strip between said displaced strips following reciprocation thereof, and to force said second transverse strip against said first transverse strip; means to bend the unwoven ends of said strips, extending beyond said tabletop, normal to said tabletop; means to alternately reciprocably displace said unwoven ends to accommodate a ring member between said alternately displaced ends and means to force successive ring members along said strips until each abuts against the previous ring; and an open ended section joining device comprising means to bring two open ended sections together so that said sections are joined at their open ends.

A still further broad form of the invention provides a method of making a filled woven strip container of prismatic shape, rigid, wherein said container has along its side edges inflatable bags, said method comprising piercing said container to provide a communication access to said bags, filling said bags with a pressurized self foaming and setting material after said container containing its contents has been compacted by pulsed compaction means.

A still further broad form of the invention provides a method of making a filled woven strip container of prismatic shape, rigid, wherein said container contents are compacted by pulsed compaction means, and the side walls are tensioned by electromagnets pulling them outwardly during compaction.

A still further broad form of the invention provides a method of making a filled woven strip container, of prismatic shape, rigid, wherein said container contents are compacted by pulsed compaction means and the side walls are tensioned by vacuum means pulling them outwardly during compaction.

The advantages of this type of container and the methods and apparatus for making it substantially lie in the fact that it can be made, in a preferred embodiment, in about 8 minutes at the filling site, at a cost only a fraction that of a normal container. The container on reaching its final destination has its contents reclaimed and the container is scrapped. The scrap value being quite significant. The container's net cost is thus only about half that of its initial cost, which is a fraction of handling and amortisation costs of a normal container.

Further financial and logistical savings accrue from the following possible advantges:

1. Where a food substance, e.g., wheat, is to be transported, once the wheat has been sealed in the container its moisture content is stabilized and enzyme and weavel activity ceases shortly thereafter, due to the oxygen supply being exhausted.

2. The containers can be filled so that their density is less than that of water and can thus be floated ashore at remote areas where normal port facilities are unavailable.

3. Agricultural pesticide treatments between different ports may be eliminated due to sealing of the containers.

4. Classified particulate matter remains classified as opposed to the mixing which occurs in bulk handling operations.

It is therefore now economically and environmentally viable to transport many types of products that were previously not possible to transport.

The invention will now be described by way of example only, with reference to the accompanying drawings, wherein:

FIG. 15 is a sectionalized view through the portion 15—15 of FIG. 14;

FIG. 16 is a sectionalized view through the section 16—16 of FIG. 14.

Figure 1:
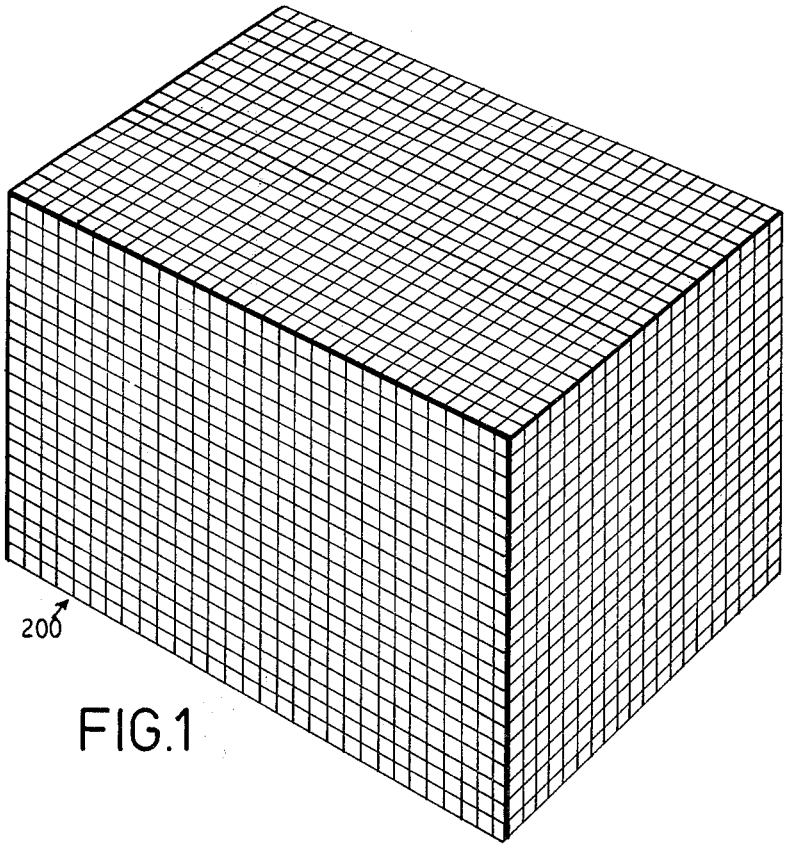
FIG. 1 is a perspective view of a container casing formed in accordance with this invention.

As shown in FIG. 1 this invention provides a container for the transportation of particulate matter. The container 200 comprises a network of woven metallic strips. The container is made in two half sections and joined across the centre. To fill the container with the desired particulate matter, the end wall is punctured and the particulate matter inserted therethrough. The container contents are then compacted by various means and the container casing is tensioned to ensure a rigid structure is provided.

Figure 2:
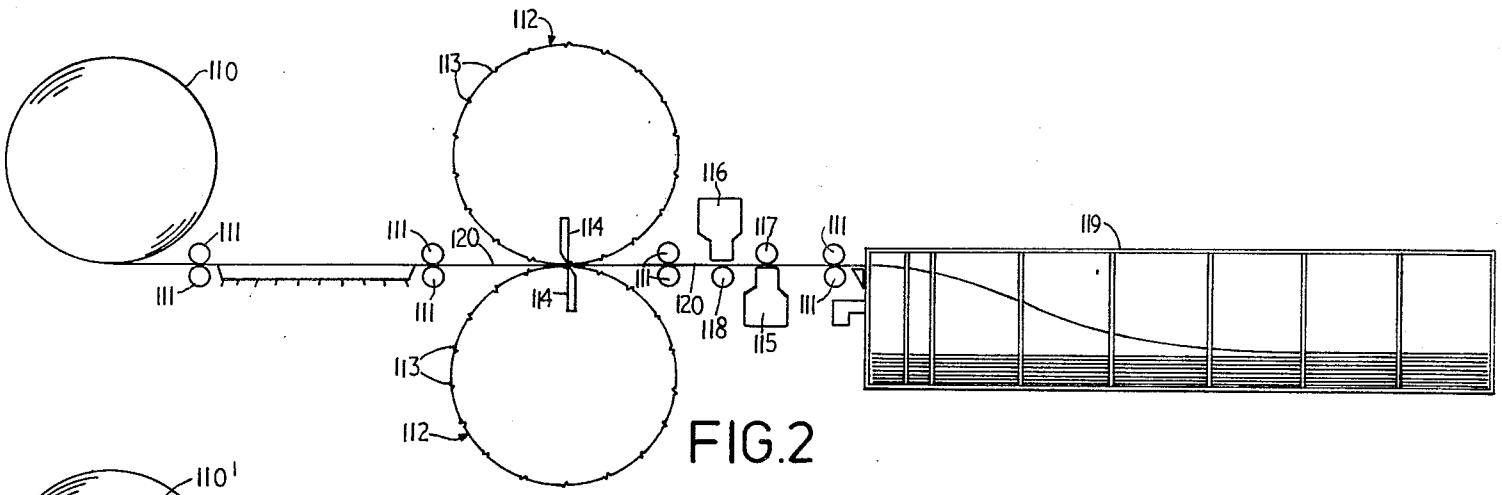
FIG. 2 is a side elevation of part of the apparatus used in forming the casing of FIG. 1.

In one form of the invention to weave the container, the first step is to obtain a series of metallic strips usually of equal length. FIG. 2 illustrates one form of obtaining these strips. The end of metallic strip is unwound from a roll 110 through feed rollers 111 which straighten the strip. The strip then passes between two forming rolls 112. The forming rolls have a series of dies 113 spaced at intervals equal to the width of the strip. The dies 113 form indentations along each edge of the strip at the strip width spacing. The indentations are in the form of an "s" and each successive indentation is inverted with respect to the previous indentation. The forming rolls 112 also have a pair of sheer blades 114 which cut the metallic strip on each full revolution of the rolls 112. Thus the circumference of the rolls 112 must be equal to the length of strip required. The strip 120 then passes through further feed rollers 111 and between an adhesive applicator 116 and an opposing roller 118. The adhesive applicator applies a portion of thermosetting epoxy resin which is actuatable by means of microwave radiation. The epoxy resin applied by the applicator 116 is applied from the start of each strip 120 to the first edge deformation on one side of the strip only. The strip then passes between a second adhesive applicator 115 and an opposing roller 117. The second adhesive applicator applies an epoxy resin from the last deformation to the end of each strip on the side opposite to the first adhesive applicator 116. The strip 120 then passes between two further feed rollers 111 before passing into a strip carrier basket 119 for storage or directly to the basket weaving apparatus as shown in FIG. 4.

Figure 4:
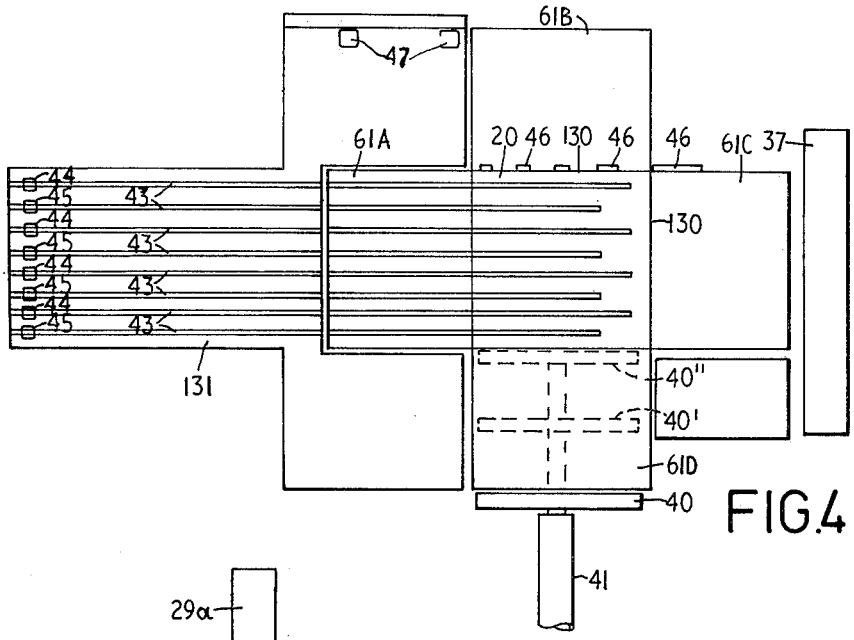
FIG. 4 is a plan view of part of the apparatus used in forming the casing.

Illustrated in FIG. 4 is a plan view of the apparatus for weaving the end portion of the casing of the container 200. A table 20 has four wing members 61A, 61B, 61C and 61D hingedly mounted 130 on each of its four sides. On the lefthand side of the table 20 and wing 61A is an extension platform 131 having a series of slots 43 therein. The slots 43 pass along the platform 131 and continue through the wing 61A and table 20 as shown. In each slot there is mounted a slide having a finger 44 or 45 which is disposed above the platform 31. The fingers 44 or 45 are movable along the slots from one extremity to the other. Also mounted on the platform 131 are two stop members 47. The wing member 61B also has a series of stops 46 mounted thereon. A cylinder 41 with a piston 42 attached to a push member 40 is mounted outside the wing 61D and in such position that the push member 40 can move over the wing member 61D from its retracted position to the position indicated by the dashed lines at 40' and 40''. Outside wing member 61C is mounted a strip carrier 37. The strip carrier 37 is adapted to receive individual strips and displace each alternate strip longitudinally with respect to the other strips.

Figure 5:
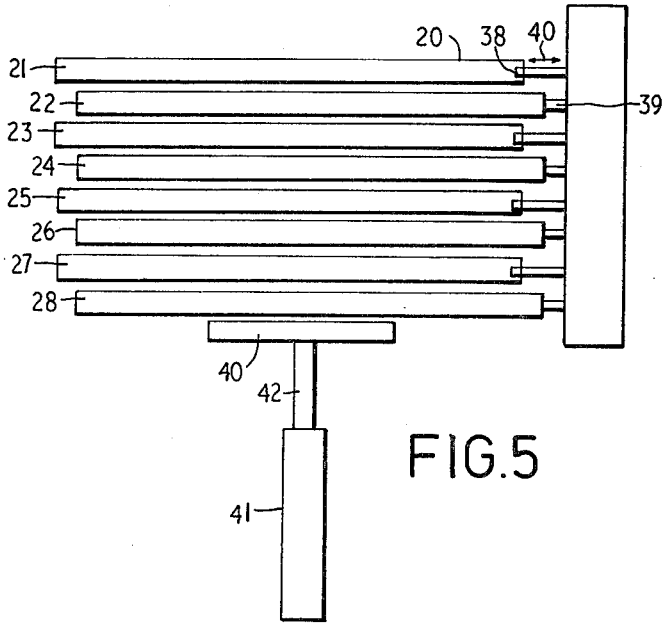
FIG 5 is a plan view showing part of the apparatus of FIG. 4 and the initial step in preparing the casing.

Turning now to FIG. 5, eight strips 21 to 28 have been fed onto the table 20 (not shown in FIG. 5) from storage baskets 119, or direct from the strip producing apparatus (FIG. 2). The strips 21 to 28 are aligned in parallel relationship and held by gripping means 38 and 39 of the strip carrier 37. The strip carrier 37 displaces each alternate strip longitudinally in the direction of arrow 40 in preparation for weaving, as shown, for reasons that will become apparent later in the process.

At this stage the centres of the strips 21 to 28 are located approximately half way along the table 20.

Figure 6:
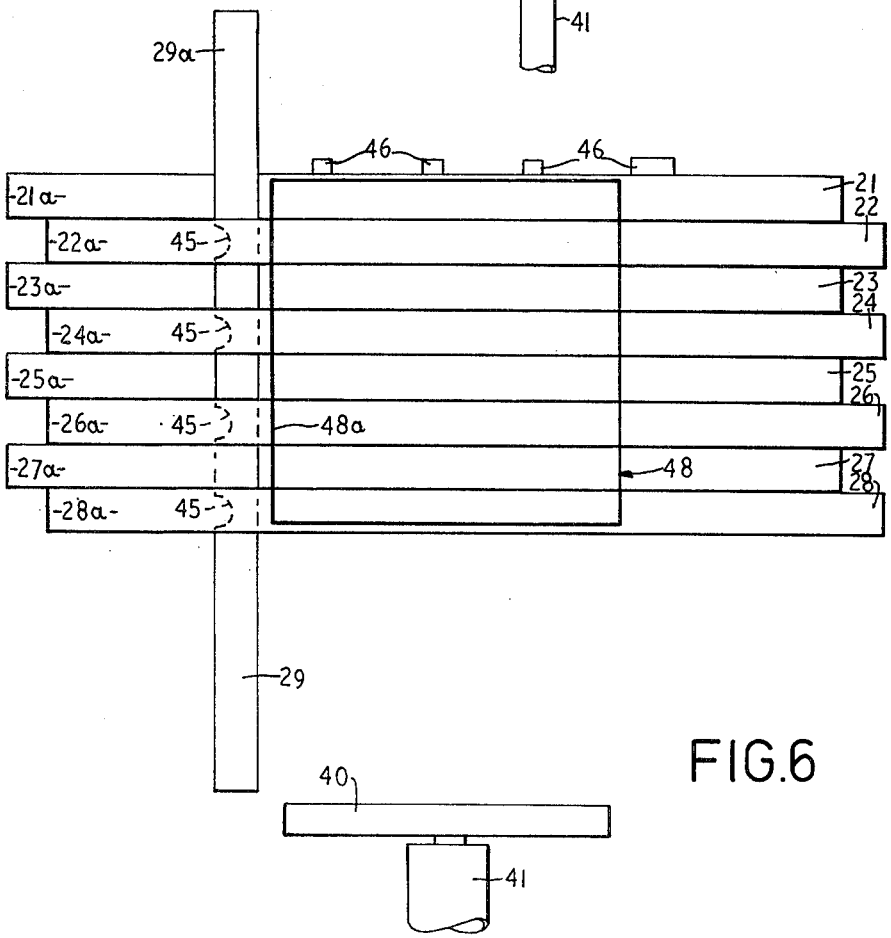
FIG. 6 is a view similar to that of FIG. 5 showing the first weave of the casing.
Figure 7:
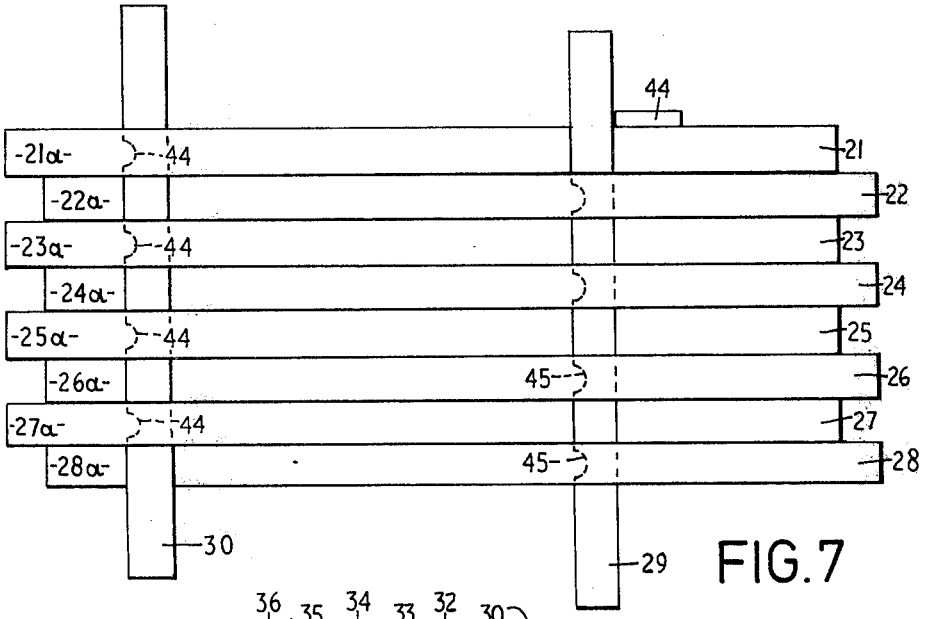
FIG. 7 is a plan view showing the second weave of the casing.

The strip carrier gripping means 38 and 39 then release the strips and the piston 42 and cylinder 41 mechanism is actuated so that push member 40 pushes the strips 21 to 28 together and against stops 46 as shown in FIG. 6.

A rectangular or square frame 48 is then lowered onto the aligned strips 21 to 28 to hold them in position. The frame 48 rests sufficiently firmly on the strips 21 to 28 so that it may be lifted relatively easily.

The ends **21*a* to 28*a* of strips 21 to 28 are then each individually gripped by electromagnets or other gripping means. The alternate end strips 22*a*, 24*a*, 26*a* and 28*a* are then raised with respect to ends 21*a*, 23*a*, 25*a* and 27*a*. The end 29*a* of a first transverse strip 29 (which has been produced by the apparatus of FIG. 2) is then fed between the raised and lowered strips 21*a* to 28*a* and the side 48*a* of the frame 48, until it reaches stop 47**.

The strip 29 is then gripped by fingers 45, shown by the dashed lines as they lie under the strips 21 to 28, and pushed along the strips 21 to 28 until it reaches stop 46. As the strip 29 is pushed along the strips 21 to 28 the frame 48 is pushed slightly upward.

The fingers 45 are withdrawn as the first strip stays in place due to the crimped portions formed on the edges of strips 21 to 28 and 29, interlocking with each other.

The alternately displaced ends **21*a* to 28*a* of strips 21 to 28 are then reversed and a second transverse strip 30 is fed between the displaced strips. Strip 30 is fed across strips 21 to 28 slightly further than strip 29, in a similar manner to the ends of strips 21 to 28**.

Figure 8:
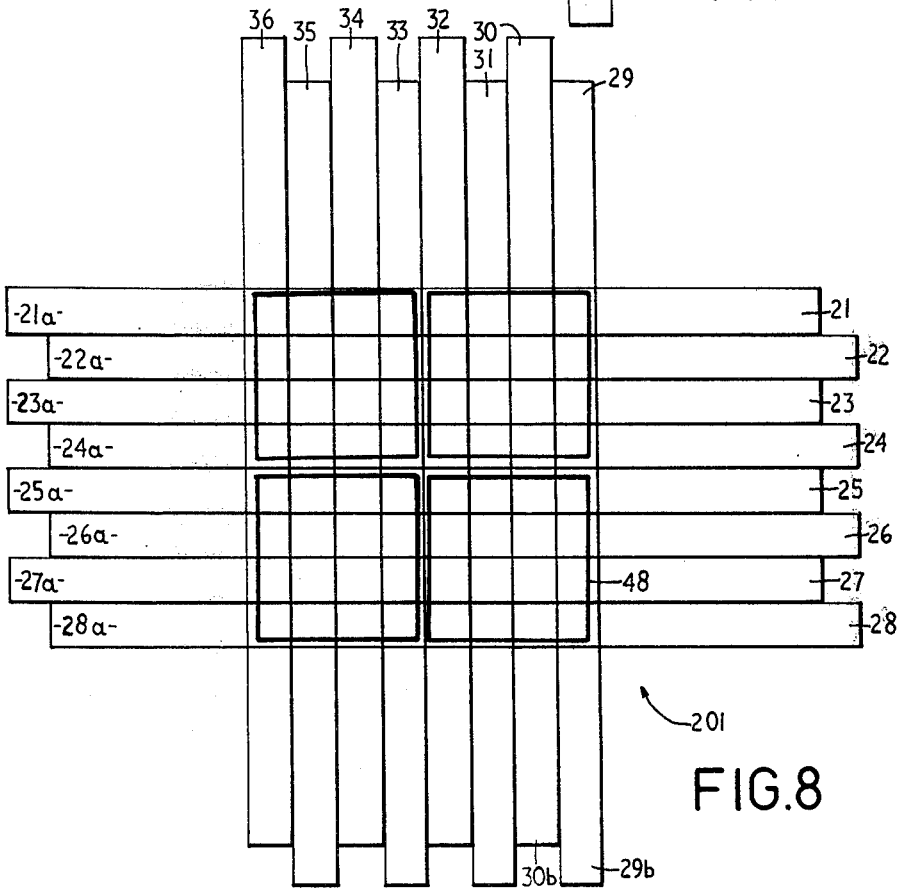
FIG. 8 is a plan view of a completed end weave.

The transverse strip 30 is then contacted by the alternate set of fingers 44 and pushed along the strips 21 to 28 until it is alongside strip 29. The fingers 44 are removed and the process repeated until the remainder of the transverse strips 31 to 36 are located in position as shown in FIG. 8. The woven section 201 produced is to become one end 201 of the container casing.

Figure 12:
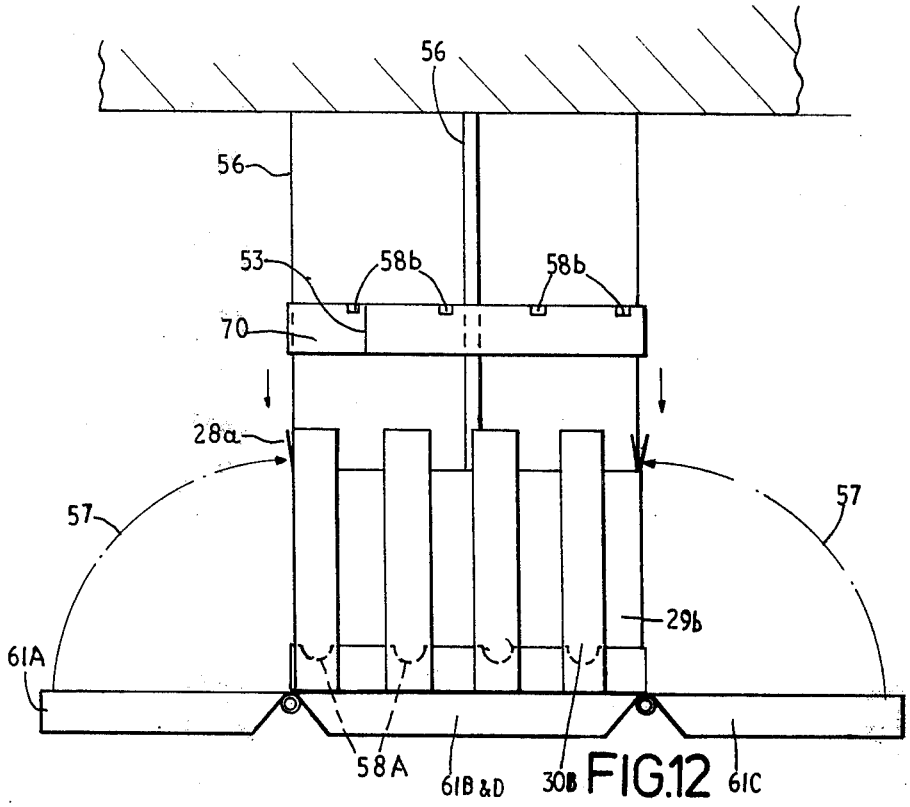
FIG. 12 is a side elevation of apparatus illustrating how the sides of the casing are formed.

In order to weave the sides of one half of the container 200 the unwoven ends of the strips 21 to 28 and 29 to 36 are bent perpendicularly to the perimeter of the end 201 which is now firmly clamped in position by frame 48. The unwoven ends are bent by the hinged wings 61A to 61D which are hydraulically pivoted in the direction of arrows 57 (FIG. 12).

Once the ends have been bent into position (FIG. 12) the frame 48 is removed and replaced by a mandrel 56. Each alternate end of the unwoven strips 21 to 36 is moved by means (not shown) of electromagnets, or other gripping means, out of alignment with the other ends so that a square or rectangular ring 49 may be pushed down the mandrel 56, by means of fingers **58*a*, to lie on opposite sides of each alternately displaced strip. The first ring 49 is pushed along the strips 21 to 36 until it is located against the end 201. The displaced ends of the strips 21 to 36 are then reciprocated and a second ring 70 is moved along the strips until it is placed alongside the first ring 49. The ends of the strips 21 to 36** alternate their positions for each successive ring.

The rings are held in place by the deformations initially formed on the strips 21 to 36.

Figure 9:
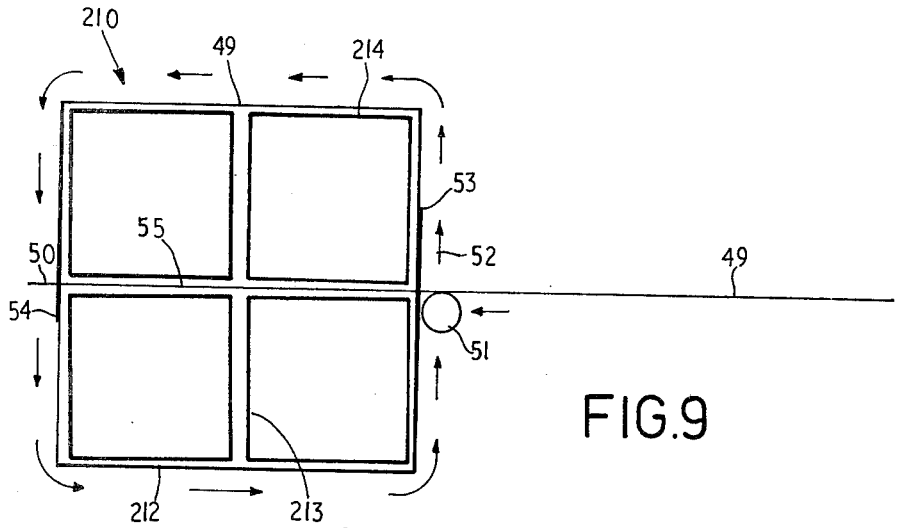
FIG. 9 is a plan view of apparatus for constructing a ring used in weaving the casing.

Each ring is made on a mandrel 210 such as shown in FIG. 9. The mandrel 210 comprises four square or rectangular sections 211 to 214. A gap is provided between each section to accommodate the cross braces.

Figure 3:
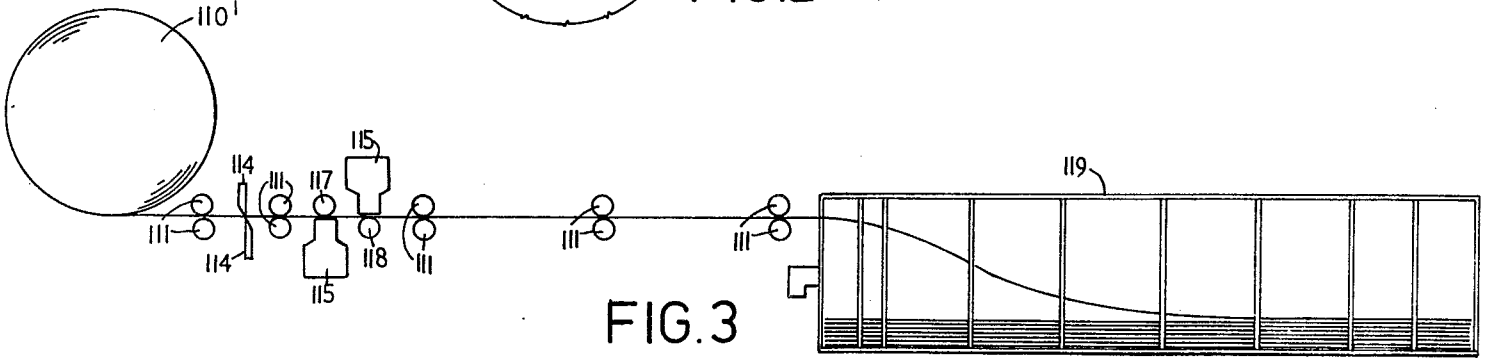
FIG 3 is a side elevation of a further part of the apparatus used in forming the casing.

The metallic strip from which the rings are formed is obtained similarly to that of the strips for the base section described with reference to FIG. 2. As shown in FIG. 3 a roll of metallic strip 110' has its end fed between feed rollers 111 which then passes between shears 114 and further feed rollers 111. Shears 114 cut the strip at appropriate intervals. An adhesive applicator 115 applies adhesive to one side of the strip at the appropriate points corresponding to joining positions, and a further adhesive applicator 116 applies adhesive to the strip at points which correspond to the joining positions of the ring. The strip then passes between further feed rollers 111 and directly to the ring forming mandrel 210 or to a basket 119 for storage. The strip may be work hardened by cold rolling in the region between the adhesive applicator and the last feed roller 111, if a particularly non-extensible strip is required.

To form a ring a length of metallic strip 49, on edge, is fed into the mandrel 210 through one of the gaps, as shown in FIG. 9, so that an end 50 protrudes from the opposite side of the mandrel 210. The strip 49 is clamped into position. A roller 51 then contacts the strip 49 where it protrudes from its original entry into the mandrel 210. The roller then advances in the direction of the arrows 52 bending the strip around the outside of the mandrel 210. In so doing the end 50 of the strip is folded under the ring at 54 and the other end of the ring 49 overlaps the initial fold at 53.

Figure 10:
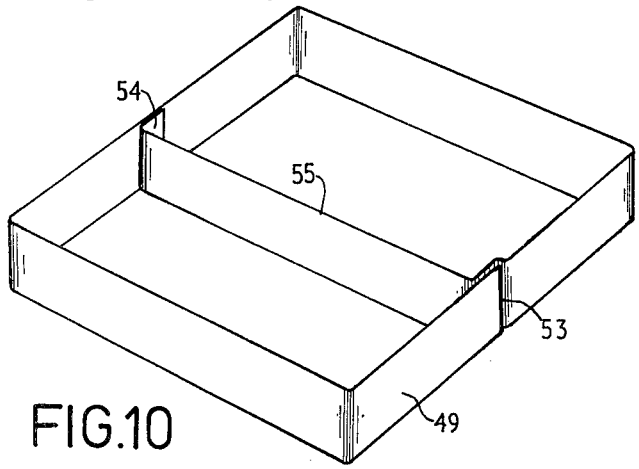
FIG. 10 is one form of a ring formed by the apparatus of FIG. 9.

Thus a ring 49 as shown in FIG. 10 is formed. The previously applied adhesive is actuated and the ring is thus bonded at joints 53 and 54.

Figure 11:
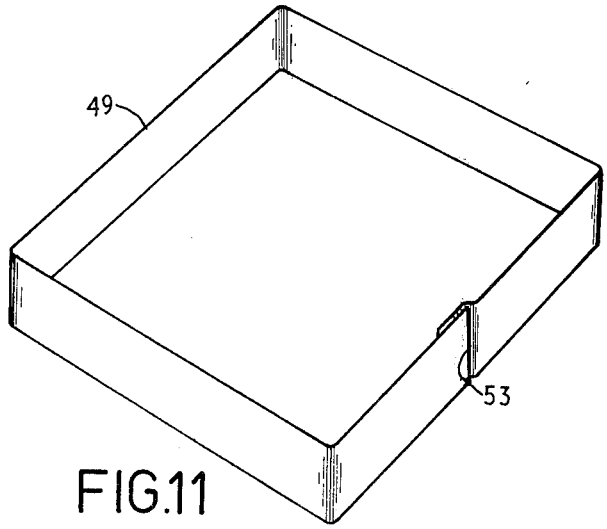
FIG. 11 is a second form of a ring formed by the apparatus of FIG. 9.

An alternate type of ring 49 is shown in FIG. 11 wherein a cross brace 55 is omitted, as all rings do not require this additional feature.

Once all the rings have been located on the upstanding strips one half of the casing has been completed.

Once two half container casings are completed, each is sprayed internally with a sealant composition which when actuated by suitable means, such as micro-wave radiation, will melt and flow into the interstices of the weave to completely seal the weave.

Figure 13:
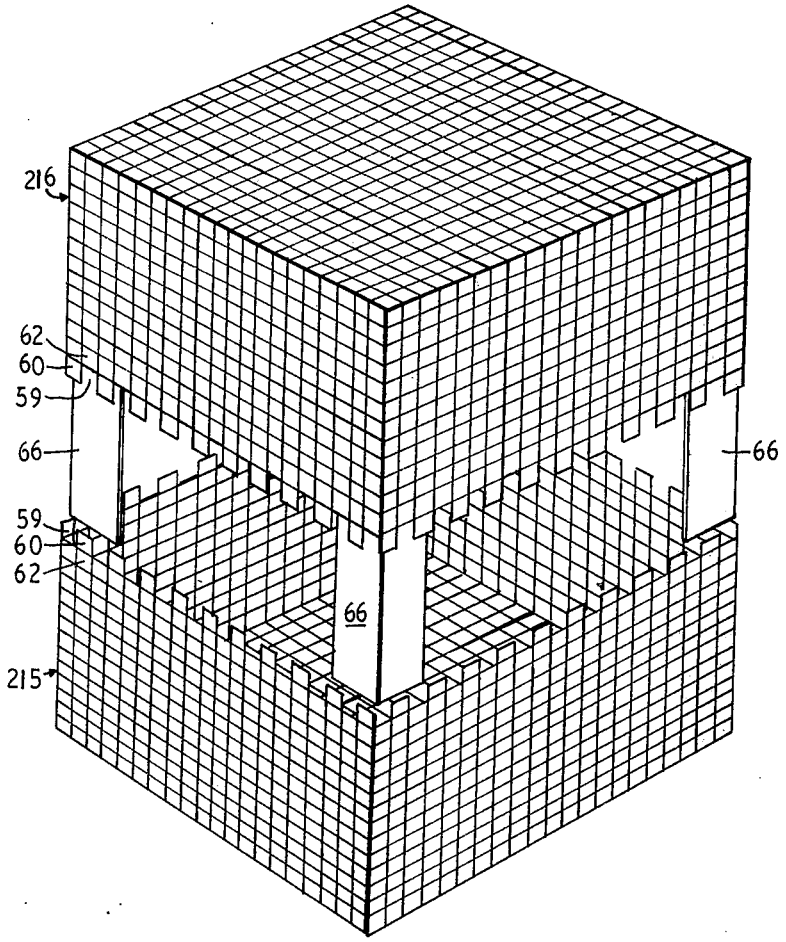
FIG. 13 is a perspective view prior to joining two half sections of the casing.

To join the two half casings the first half is placed on its woven end (FIG. 13). The second half 216 has compression bags 66 attached to each of its end corners. Each compression bag 66 is an elongated, inflatable, flexible tube adapted to extend along each of the four longitudinal corners of the casing. The purpose of the compression bags 66 will be fully described hereinafter.

The second half 216 is then inverted and aligned above the first half 215. The unattached ends of the compression bags 66 drop into the first casing 215. The two half casings are then brought together so that the extending alternate strip ends of each casing match up with the alternate recessed ends of the opposite casing.

This can be clearly seen in FIG. 15 wherein the extending end 60 has slid over the outside of the recessed end 59 of the opposite half.

The epoxy resin glue 63 which has been applied to the outer surface of end 59 and inner surface of end 60 is then actuated by appropriate heat or micro-wave means to bond the two surfaces together. Simultaneously the inner sealing compound 65 is actuated and flows into the interstices of the weave, to seal the casing.

Figure 14:
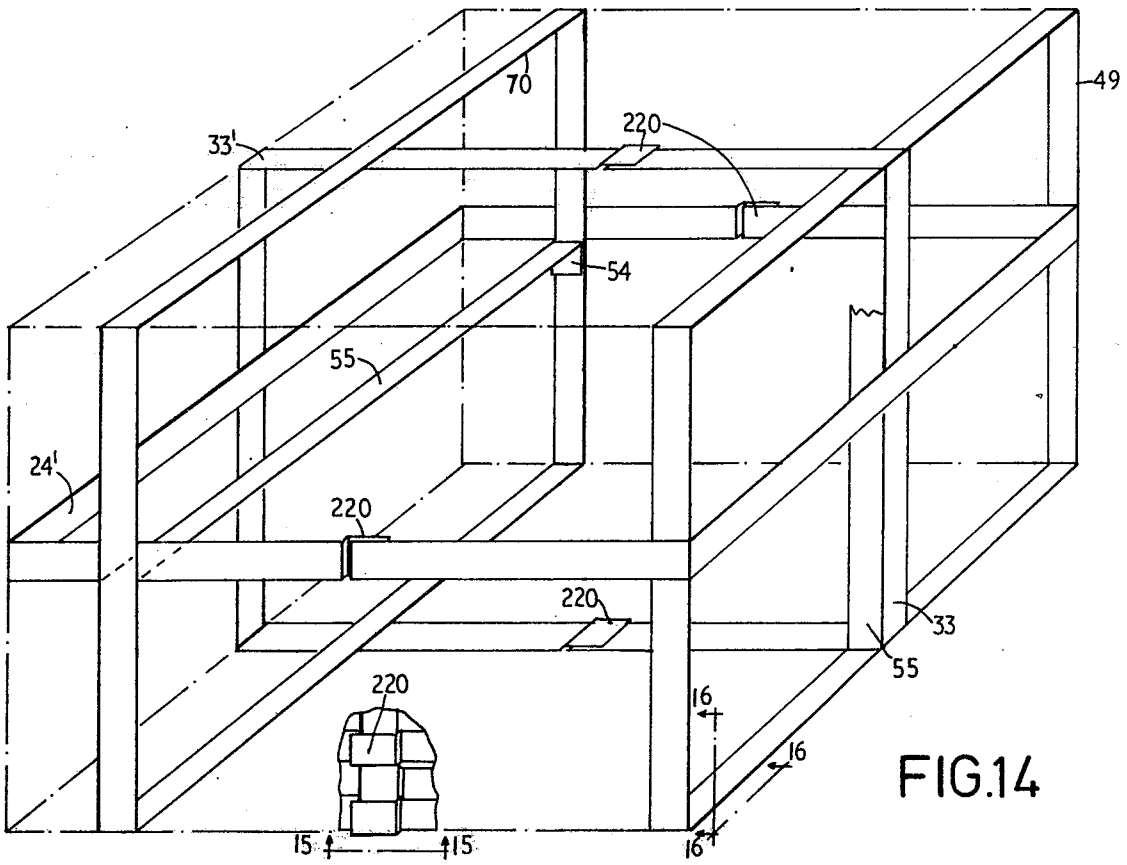
FIG. 14 is an exposed perspective view of a completed container casing illustrating the structural members of the casing.

The container casing is now fully constructed and ready to be filled. As can be seen from FIG. 14 the casing 200 has a series of glue joints 220 around the centre of the casing in the longitudinal direction. Each glue joint 220 has sufficient area such that it is actually stronger in shear than an individual metallic strip. Thus there is no chance of the container being broken in half due to insufficient strength of the glue.

The two rings 49 and 70 shown have cross braces 55 in opposite directions. The cross braces 55 obviously limit the amount of "bulge" which is likely to occur in the side walls of the casing 200. The cross braces 55 may also be diagonals and are staggered across the casing at various points. The thickness of the rings 49 and 70 may be varied such that thicker, stronger rings are used closer to the centre of the container to accommodate the increased hoop stresses at that area.

Figure 17:
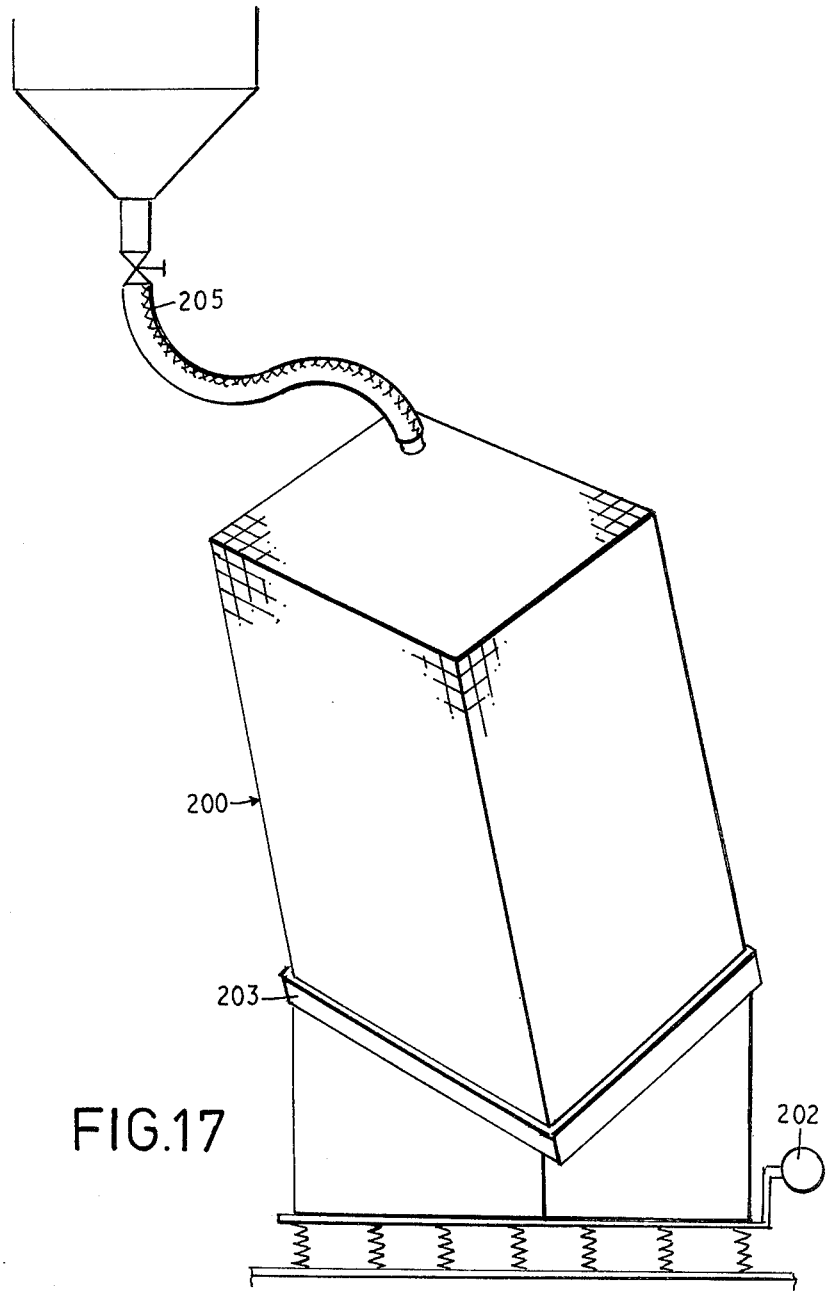
FIG. 17 is a perspective view of a container mounted on filling apparatus.

In order to fill the container 200 it is stood on its end, as shown in FIG. 17, and placed on a vibratory table 203. Attached to the vibratory table 203 is a strain gauge 202 which is adapted to measure the weight of the container and its contents.

To fill the container a tubular spear 205 is forced through the uppermost end of the container by puncturing the woven end. The container is filled by feeding the particulate matter through the spear 205. A further spear may be inserted through the end of the container to exhaust the displaced gas from the container 200. Once the strain gauge reaches the desired required weight the filling is stopped and the spears removed.

The vibratory table 203 is set in motion to compact the particulate matter. After a suitable period for compaction, the container is removed from the table 203.

The container end is then punctured at each corner to provide a communication passage 204 with the compaction bags 66 which were previously inserted.

Liquid polystyrene foam 69 or air, carbon dioxide or other gases or liquids, is then forced into the bags 66 under pressure. The foam 69 expands in the bags and forces the longitudinal corners of the container 200 away from the compacted particulate matter 67, in the direction of arrows 68. This procedure slightly expands and tensions the container casing 200 so that it becomes extremely rigid. Any voidage at the top end of the container may be filled by further foam to maintain the compaction of the material.

The spear openings are then sealed by welding or gluing a plate therein or inserting a plug.

In some instances the product is to be transported in a particular environment such as carbon dioxide. If this is the case the container is filled with the gas prior to filling with the material.

The rigidity is actually due to the solid block of particulate matter which has been formed within the casing, and thus all compressive forces are carried by the particulate matter and not the casing 200.

The container may now be handled by means of scissor type grabs or electromagnets if it is made from steel strips. Additionally a fork lift handling base may be added underneath, and/or lifting brackets may be affixed at appropriate points.

Where hereinbefore the metallic strips have been described as having glue joints it is obvious that more conventional types of joining the strips, such as welding or rivetting, may be employed.

What we claim is:

1. A container for particulate matter, comprising a closed case of rectangular or square prismatic shape having two opposite end walls and two pairs of side walls extending between said end walls, said case being formed from two open ended sections each having an end wall and four side walls extending therefrom, said sections being joined at their open ends, each end wall being formed from at least two sets of interwoven metallic strips, the strips of each set extending parallel to one another and transversely to the strips of at least one other set, each set of strips having free unwoven ends extending substantially normally from said woven end and having a further set of metallic ring strips interwoven with said free ends, said further set of metallic ring strips extending around the four side walls to form said four side walls of each section with said extending strips from said end, said side walls having at least each alternate strip which extends from said end extending beyond the last metallic ring strip of the side wall such that the two open ended sections are brought together at their open ends and each extending strip is joined in an overlapping manner to a strip which extends from the end of the other section, such that the alternating weave is continued, to form said casing wherein each strip from the ends of said casing becomes an independent ring, and wherein each adjacent strip of at least one set being spaced laterally from one another by a distance which is small in relation to the width of the strips of said one set.

2. The container of claim 1, wherein each joined extending strip is joined together by gluing or welding the overlapping portions to each other.

3. The container of claim 1, wherein metallic cross braces extend between opposite side walls of the open ended sections.

4. The container of claim 3, wherein each cross brace is a continuation of a woven ring strip which extends around the four side walls.

5. The container of claim 4, wherein at least some of the cross braces extend between the mid points of opposite side walls.

6. The container of claim 1, wherein the inside of the casing is coated with a sealant material.

7. The container of claim 1, wherein the outside of the container is coated with a sealant material.

8. The container of claim 1, wherein a tubular inflatable bag is placed along each of the inside corners formed by the intersections of adjacent side walls.

9. The container of claim 1, wherein each of the strips which form each end wall have indentations formed along each edge at spaces equal to the width of the strips, so that the strips can be tightly interwoven without damaging the edge of any one strip to also provide accuracy of construction and resistance to unweaving during assembly.

* * * * *